US005399015A

United States Patent [19]

Zhi-qiang et al.

[11] Patent Number: 5,399,015

[45] Date of Patent: Mar. 21, 1995

[54] ABRUPT-REVERSAL HELICAL WATER-IN-OIL EMULSIFICATION SYSTEM

[76] Inventors: Xie Zhi-qiang, Door 207, No. 74, Shang-Ye Xin-Cun, Hangyang City, China; Liu Erh, 395 Barway Dr., Yorktown Heights, N.Y. 10598

[21] Appl. No.: 965,637

[22] Filed: Oct. 23, 1992

Related U.S. Application Data

[63] Continuation-in-part of Ser. No. 883,688, May 15, 1992, abandoned.

[30] Foreign Application Priority Data

| | | | |
|---|---|---|---|
| May 20, 1991 | [CN] | China | 91 1 06703.5 |
| May 20, 1991 | [CN] | China | 91 1 06704.3 |
| May 20, 1991 | [CN] | China | 91 2 12703.1 |
| May 20, 1991 | [CN] | China | 91 2 12704.X |

[51] Int. Cl.[6] ..... B01F 5/06

[52] U.S. Cl. ..... 366/339; 366/176; 366/182; 138/42

[58] Field of Search ..... 366/150, 162, 167, 173, 366/176, 177, 182, 336, 338, 339, 340, 163, 174; 138/37, 42; 239/398, 407; 137/597, 602, 625.3, 625.4, 896

[56] References Cited

U.S. PATENT DOCUMENTS

| | | | |
|---|---|---|---|
| 1,140,548 | 5/1915 | Vogelsang | 366/163 |
| 3,709,468 | 1/1973 | Ives | 366/339 |
| 4,034,964 | 7/1977 | Larson | 366/338 |
| 4,053,141 | 10/1977 | Gussefeld | 366/339 |
| 4,344,752 | 8/1982 | Gallagher, Jr. | 137/896 X |
| 4,441,823 | 4/1984 | Power | 366/167 |
| 4,466,741 | 8/1984 | Kojima | 366/339 |
| 4,514,095 | 4/1985 | Ehrfeld et al. | 366/340 |
| 4,560,284 | 12/1985 | Chen | 366/338 X |
| 4,747,697 | 5/1988 | Kojima | 366/339 |
| 4,869,849 | 9/1989 | Hirose et al. | 366/340 X |
| 4,989,988 | 2/1991 | Hutter et al. | 366/167 X |

FOREIGN PATENT DOCUMENTS

| | | | |
|---|---|---|---|
| 56423 | 7/1982 | European Pat. Off. | 137/602 |
| 84180 | 7/1983 | European Pat. Off. . | |
| 140653 | 3/1980 | Germany | 366/338 |
| 1385569 | 2/1975 | United Kingdom . | |
| 1437576 | 5/1976 | United Kingdom . | |

*Primary Examiner*—David A. Scherbel
*Assistant Examiner*—Charles Cooley

[57] ABSTRACT

A mechanical emulsifying apparatus makes oil/water emulsions without chemicals and without moving parts. Oil is pumped at a nominal pressure axially into an emulsifying stack of alternately clockwise and anti-clockwise abrupt-reversal helical spin-reversing helix disks, with integrally machined separator necks. The stack transfers partially emulsified oil/water mix from one helical disk to the next. Water is introduced directly into the emulsifying stack (for heavy oil, from the side) at a pressure higher than the oil pressure, to shear into the oil stream. The oil/water stream, as it penetrates the oil stream, follows a spin-reversing flow path through the stack. Each disk is cut with a helical pathway, alternately clockwise or anticlockwise, and with a separator neck, for an abrupt transition at a nominal 135 degree angle. The oil and water streams, partially merged, strike the transition at the separator neck between helix disks. This reverses the helical flow abruptly. The oil and water increasingly emulsify during the multiple spin-reversals through the stack, ready for immediate injection into the atomizing high pressure steam or airstream burner mechanism. The clockwise and anti-clockwise disks, each with an integral separator neck, are simple to cut and are easy to replace when required by wear, clogging or change of fuel. A low-demand water injection mechanism cuts off the water injection as the diesel engine slows down to a nominal rpm just above idle speed, to eliminate the problem of water-injection-caused stalling at idle speeds.

4 Claims, 2 Drawing Sheets

ABRUPT-REVERSAL HELICAL WATER-IN-OIL EMULSIFICATION SYSTEM

CROSS-REFERENCES TO RELATED APPLICATIONS

This is a continuation in part of previously filed application Ser. No. 07/883,688, now abandoned, filed May 15, 1992, claiming priority from four applications originally filed in China, as follows:

91 1 06703.5)
91 1 06704.3)
91 2 12703.1)
91 2 12704.X)
filed May 20, 1991, China (PRC).

BACKGROUND OF THE INVENTION

1. Field of the Invention

This invention relates to water/oil emulsifying for combustion efficiency, and more particularly to mechanical emulsifying apparatus using no chemicals and having no moving parts, operating by spiral-reversing the oil flow after water injection to achieve a temporary emulsification.

Emulsions are systems with at least two phases, which are not or only to a small extent soluble one in another. It is distinguished between a continuous phase, in which the other, the discontinuous one, is distributed in the form of small droplets, forming two groups. There are the oil-in-water and the water-in-oil emulsions. Every high polar, hydrophile fluid falls into the category that water is in, whereas the hydrophobic, non-polar fluids are treated similar to oil. If oil and water are brought together and treated very strongly mechanically, one is dispersed into the other and a multitude of droplets are formed. If the system stays at rest, differences in the density lead to the separation of the phases.

2. Description of Related Art

Water/oil emulsions improve combustion. The oil droplets shatter in microexplosions as heated water expands into steam. The shattered oil droplets have more surface for vaporization required for burning. Water/oil emulsions normally require chemical additives or moving agitators.

SUMMARY OF THE INVENTION

This invention provides a mechanical emulsifying apparatus to make oil/water emulsions without chemicals. Oil is pumped at a nominal pressure axially into an emulsifying stack of of alternately directed spin-reversing helix disks with separator necks. Oil and water are introduced into the emulsifying stack of spin-reversing helix disk pairs at an input end. For heavy oil, the water enters from the side, at a pressure higher than the oil pressure, to shear into the oil stream. The water stream penetrates the oil stream for a mixed stream. The mixed stream follows a spin-reversing helical flow path through the emulsifying disk stack. Each disk is cut with a helical pathway, either clockwise or anticlockwise. The spin-reversing helix disks alternate, clockwise and anticlockwise, and have integral separator necks. There is an abrupt right angle reversal transition of the mixed stream from disk to disk at the separator necks. The mixed oil and water stream, only partially emulsified as the water stream shears into the oil stream, strikes the slightly-greater-than-right angle formed by a first helical disk, then follows the helix until the composite stream hits the transition at the first separator neck, where the helical paths reverse. This abrupt spin-reversing helical flow is guided clockwise at first. It then makes a virtual right angle turn to follow the next helical path, with great turbulence as it makes the transition from clockwise helix to anticlockwise helix. The oil and water mixture becomes more and more emulsified during the multiple spin-reversals as the liquid stream passes through the stack. Exiting the stack, the oil/water emulsion is atomized into a combustion chamber very quickly, prior to the eventual stratification or separation of oil and water. Fuel savings, improved heat transfer, soot reduction and reduced polluting emissions are experienced.

It is the object of the invention to provide an elegant geometric mechanical emulsification of oil/water, without chemical additives and without complicated agitation systems.

A feature of the invention is an emulsifying disk stack having a linear set of alternating abrupt spin-reversing helix disks. Each pair forms a abrupt spin-reversing helix path with a virtual right angle where the clockwise helix meets the anti-clockwise helix, and conversely. This creates a complex abrupt spin-reversing helical path for the oil stream, penetrated by the higher pressure water stream to form a composite oil/water emulsifying turbulent stream. This turbulent emulsified oil/water stream passes directly to the burner nozzle, where it emerges as a jet of emulsified oil/water to be atomized with high pressure steam or air for burning.

Other objects, features and advantages of the invention will be apparent from the following specification and from the annexed drawings and claims.

DETAILED DESCRIPTION OF THE PREFERRED EMBODIMENT

Figure 1:
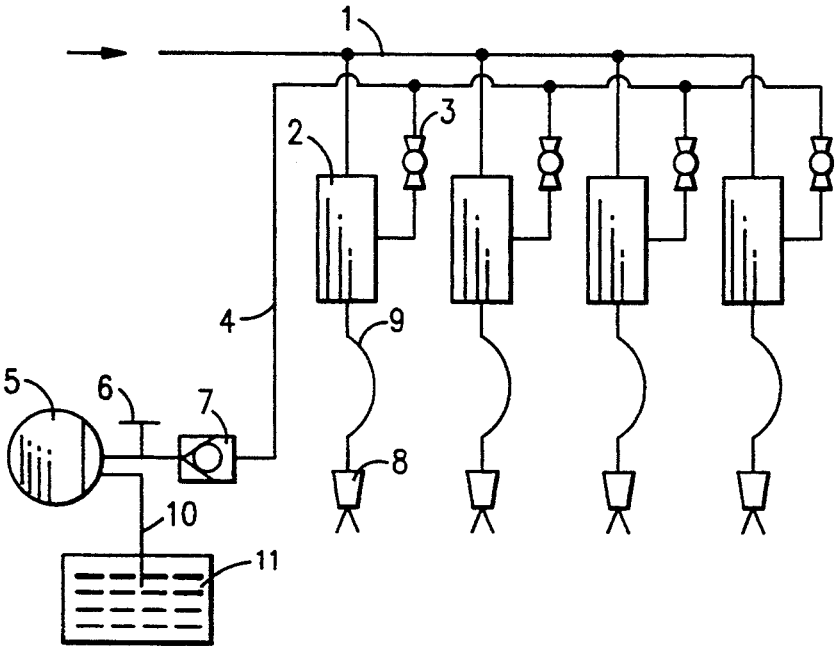
FIG. 1 is an schematic diagram of a multiple nozzle system of an oil/water emulsion oil burner.

FIG. 1 shows the invention in a multiple nozzle system. Oil inlet piping 1 supplies fuel oil (at a medium pressure) to emulsifying stack 2. Water inlet gate valve 3 introduces water at high pressure from water line 4 to each emulsifying stack 2. The water pressure needs to be higher than the oil pressure as the oil stream and the water stream enter the emulsifying stack 2. For light oil such as Number P fuel oil (diesel oil) the differential pressure of the water may be minimal.

Water is supplied to water line 4 from water pump 5, a constant pressure pump. Water pump 5 feeds water via shutoff valve 6 and check valve 7 and gate valve 3 to each emulsifying chamber 2. Emulsifying chamber 2 feeds an oil/water emulsion stream to jet nozzle 8 via flexible outlet piping 9. Pump 5 gets its water supply via water feed piping 10 from water supply 11. For use with light oil, a relatively simple float-controlled water with a constant head may be used instead of a constant pressure pump.

Figure 2:
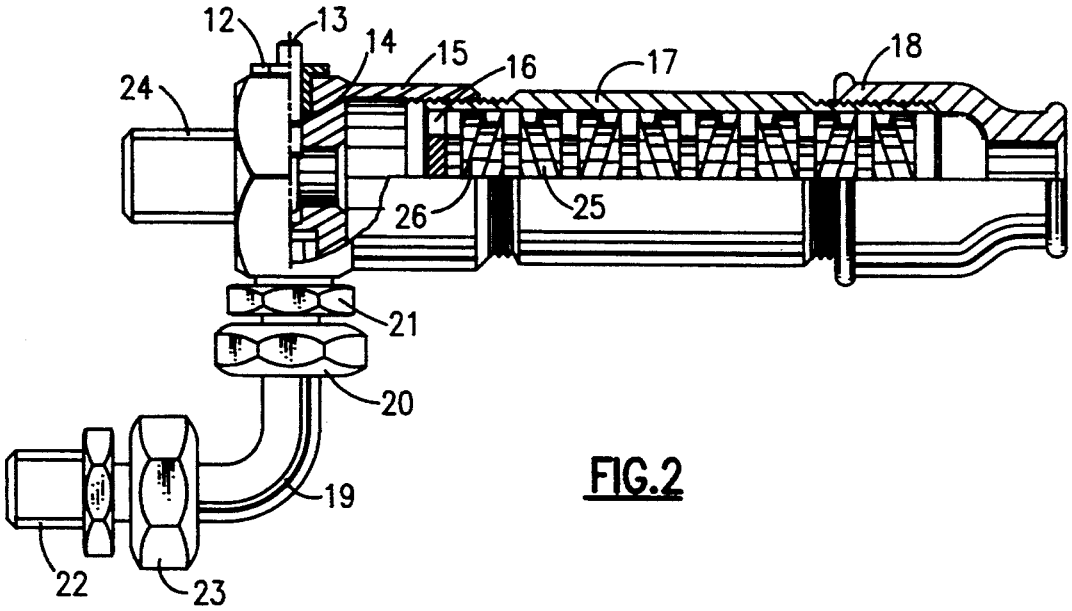
FIG. 2 is a side elevation cutaway view of the emulsifying stack of abrupt-reversal helical spin-reversing helix disk pairs.
Figure 5:
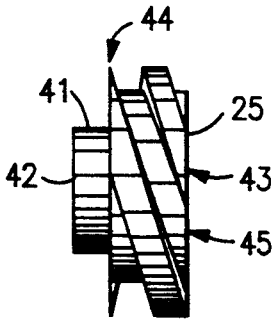
FIG. 5 is a side elevation view of a clockwise helix disk with a separator neck.
Figure 6:
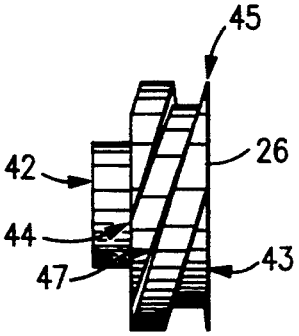
FIG. 6 is a side elevation view of an anticlockwise helix disk with a separator neck.

FIG. 2 shows in cutaway the mechanical emulsifier stack (2, FIG. 1). Water fed to the emulsifier stack enters via a needle valve assembly 12–14 which permits water flow adjustment in the range of water-to-oil ratio of 0–15%, manually or by any of several well-known automatic techniques. Adjuster handle 12 permits adjustment of needle 13 which is sealed against leaking by O-ring packing 14. The emulsifier stack comprises a cylindrical housing 15. A nozzle separator 16, in the form of a disk with a cutout, directs the oil/water mix axially through cylindrical housing 15. Cylinder 19 screws into the aperture of concentric connector-/adapter 18. Adapter 18 seals the opening of the emulsifying stack and acts to hold together the stack of alternating helical spin-reversal helix disks 25–26 and any intervening nozzle separators 16. Tubing 19 carries water, at a pressure slightly to greatly higher than the pressure of the oil, depending upon the viscosity of the oil, to the emulsifying stack 2. Water tube connectors 20–23 complete the water supply to the emulsifying stack. The emulsifying stack includes, in the embodiment shown, eight individual helical spin-reversal helix disks 25–26, alternately clockwise 25 and anticlockwise 26, within the body of emulsifier stack cylinder 17. There is a 90+ degree turnabout as the oil/water stream passes from each helical spin-reversal helix disk 25 or 26, to the next helical spin-reversing helix disk. Each disk 25, 26 preferably has an integral separator neck portion 41 as shown in FIGS. 5 and 6.

This arrangement ensures optimal turbulent water flow within the emulsifying stack. The oil/water mixture hits each 90+ degree turnabout hard enough to cause emulsification. The turbulent flow creates a shear force due to the differences between oil and water in viscosities, velocities, densities and surface tensions. This causes emulsification mechanically, without the need for agitators or chemicals.

The oil supply is provided by conventional means with metering wherever required, by conventional piping 24.

OPERATION

FIG. 1 shows how the oil/water emulsion is used in a multiple jet system. Each jet 8 is ready to pump oil/-water emulsion to its jet for burning.

FIG. 2 shows the emulsifying stack of abrupt-reversal helical spin-reversing helix disk pairs. The operator selects a stream size for the oil by means not shown. The water supply is selected at each burner nozzle by setting the needle valve 13. The water is under constant pressure, and thus the fuel oil supply and water supply are matched to each other, dependably supplying oil/water emulsion to the related burner nozzle. Helix disks 25 and 26 are respectively clockwise and anticlockwise, arrayed alternately in the stack with their grooves aligned so as to supply a path with high impact at the approximately 135 degree turnabout, via the opening about the separator neck, to the complementary helix. The two segments form a compact, complex fluid path in which a reversal occurs at each helical disk transition. The oil/water mixture hits a virtual flat 47 of the land of the opposite helix, causing an abrupt reversal of fluid flow at the far end of the helical path through the first disk, splattering off that flat into momentary turbulence, then resuming fluid flow further along on the path to emulsification.

MECHANISM

Figure 3:
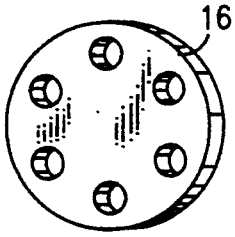
FIG. 3 is a view of a nozzle separator.
Figure 4:
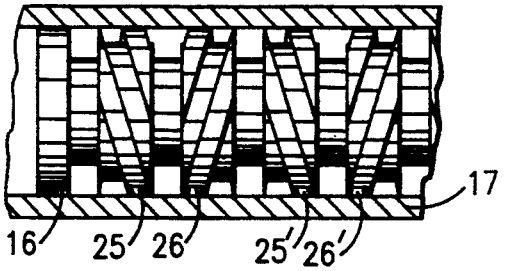
FIG. 4 is a cutaway partial side elevation view of the emulsifying stack.

FIG. 3 shows the nozzle separator 16 which starts the flow of the mixed (not yet emulsified) oil/water stream through the stack 19. The nozzle holes initiate a turbulent flow of droplets, along the axis of the stack 17. FIGS. 4–6 show how the abrupt-reversal helical-spin-reversing flow-control helix disks 25, 26 are configured. Separator necks 41 hold individual helix disks in place, allowing fluid flow around the separator necks. Arrows showing fluid flow direction in FIGS. 4–6 point to leading edges 42; a trailing edge 43 mates with the leading edge of the following helix disk in a complementary pair 25–26, with oppositely turned lands and grooves forming flow channels. Arrow 44 points to a leading edge; arrow 45 points to a trailing edge. Leading edge and trailing edge are designated for discussion only. (So long as the complementary pair relationship is continued, the helix disks could be reversed in the stack without loss of capability.) Folded arrow 46 shows the abrupt reversal of spin direction in fluid flow. The water-in-oil mixture at the entry of the stack is subjected to the cumulative effect of the repeated partial emulsifications in the turbulences of the repeated reversals of spin direction in fluid flow as it transits the stack. The fluid almost reciprocates but does not quite reciprocate; the fluid flow has many abrupt reversals. Only the fluid moves; the helix disks 25, 26 remain motionless within the stack 17.

FIG. 4 shows stack 17 with nozzle separator 16, clockwise helix 85 with its integral separator neck 41 facing the flow, anticlockwise helix 26, . . . and final clockwise/anticlockwise pair 25'/26'.

FIG. 5 shows detail of clockwise helix 25 with its separator neck 41 facing the flow.

FIG. 6 shows detail of anticlockwise helix 86 with its separator neck 41 facing the flow.

The helix disks are easily manufactured by automatic screw machines, which can cut the clockwise helix 25 or anticlockwise helix 26 and form the separator neck 41 for a cutoff where burrs would not affect assembly into the stack. The helix disks can also be injection-molded from plastic. Where appropriate, the helix disks may be cut or molded in helical spin-reversing helix disk pairs, or in stacks for easy assembly and low cost. Manufacture in stacks minimizes or eliminates the requirement to fix the disks against rotation. Where individual disks are used, it may be desirable to broach a rectangular central hole, but generally the disks may be fixed against rotation by a tight fit.

Figure 7:
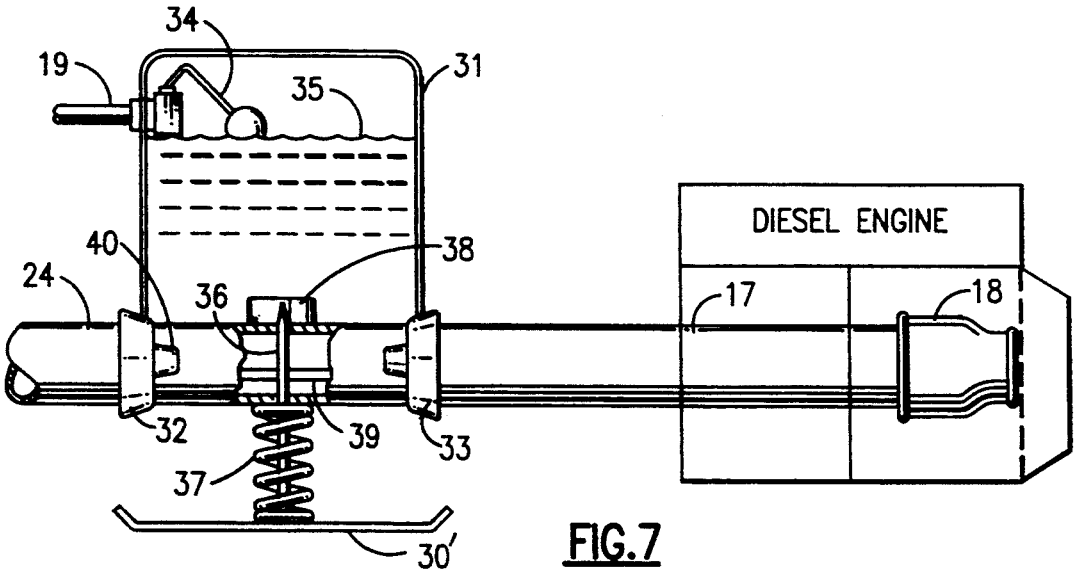
FIG. 7 is a diagram of an emulsifying stack with water metering for a diesel.

FIG. 7 shows an embodiment for use with a diesel engine.

NOTE: The diesel is very efficient because of its heat cycle and high compression, not because of its efficient burning of fuel. Evidence of this is the black sooty smoke from the diesel exhaust stack. Water injection is not primarily to advance post-combustion operating efficiency of the engine, although the resulting steam expansion within the cylinder may have salutory effect. The emulsified oil/water fuel enhances combustion efficiency. The microdroplets of water scattered throughout the droplets of fuel oil provide a great number of microexplosions of steam as the fuel/water emulsion is heated by compression during the final portion of the compression stroke and is heated by combustion and the resulting additional compression during the early portion of the power stroke, as neighboring oil/water emulsified fuel is fired. These steam microexplosions within the emulsified fuel/water droplets shatter the droplets and provide vastly enlarged surface area for oxidation during combustion. This increased oxidizable surface area increases the completeness of combustion, greatly decreasing unburned oil emission, soot, and the expense of wasted unburned fuel.

Fuel oil enters the active arena at oil pipe 24, which is located between the fuel injection selection mechanism and the cylinder feed jet nozzle 8. Emulsifier stack 19 holds the complementary-pair helix disks 25/26. Emulsion water is fed by low-demand mechanism 30, which meters water into the fuel oil stream with a roughly linear rise as oil flow increases in response to demand for power or speed. Low-demand mechanism 30 effectively stops water flow when demand falls below the threshold of demand corresponding to "idle" for the diesel engine—or, more specifically, to the threshold of low demand at which the diesel engine requires unwatered fuel oil to continue running. While the theory is not certain, it is believed that the heat absorbed in converting the water microdroplets to steam adversely affects the ignition, making water injection counterproductive at idle speed. For example, a typical diesel engine may run very well on oil/water emulsion at speeds above 800 rpm, achieving economies of power and increases in combustion completeness-but stall out below 800 rpm.

LOW-DEMAND WATER INJECTION MECHANISM

The low-demand water injection mechanism 30 includes the following elements shown semi-schematically in FIG. 7.

31 water reservoir
32 fuel line fitting
33 emulsified fuel/water line fitting
34 float valve mechanism
35 nominal water level mark
36 needle valve
37 needle valve spring
38 needle valve seat
39 needle valve fuel flow responsive diaphragm
40 fuel venturi jet As the fuel flow from fuel venturi jet 40 varies above the demand threshold, water injection varies in a ratio which approximates a linear increase to retain a standard water/fuel oil ratio which is emulsified temporarily in stack 17 just before being fed to cylinder inlet jet 8. Needle valve 36 alters the water feed as it is moved by needle valve fuel flow responsive diaphragm 39 against the pressure of needle valve spring 39. As fuel demand falls below threshold, needle valve 36 closes against needle valve seat 38, shutting off the water injection as required during the under-threshold rpm (for example, 800 rpm) slightly above the base idle speed for the engine.

While the invention has been shown preferably in the form of a fuel emulsifier, it will be clear to those skilled in the art that the modifications described, plus other alternatives, may be pursued without departing from the spirit and scope of the invention, as defined in the following claims.

What is claimed is:

1. A mechanical emulsifier for water-injected fuel oil, having at least one controllable fuel oil input, having at least one controllable water input, having a water-in-oil fuel flow, and having at least one output for said water-in-oil fuel flow, comprising:

a) a stack housing having connections for said fuel oil input, for said water input, and for said output, said stack housing encompassing a fluid flow channel for said water-in-oil fuel flow;

b) a stack of alternately clockwise and anticlockwise cut abrupt-reversal helical spin-reversing flow-control helix disks, arrayed within said stack housing along said fluid flow channel in clockwise/anticlockwise complementary pairs;

c) each of said helix disks having a helically cut portion having a first side and a second side, with helical lands and helical grooves defining with said stack housing at least one helical fluid flow channel from said first side to said second side with a characteristic helical spin of said water-in-oil fuel flow;

d) a set of separator necks, intervening between helix disks in said stack;

whereupon said water-in-oil fuel flow, which has said characteristic helical spin within said grooves, reverses its spin abruptly as said water-in-oil fuel flow crosses a related one of said separator necks, strikes the oppositely-cut helical land of the next helix disk and enters the oppositely-cut helical groove of said next helix disk, the abrupt reversal of said water-in-oil fuel flow causing a transition of sufficient turbulence for incremental emulsification of said water-in-oil fuel flow resulting in cumulative emulsification as it transits said stack.

2. A mechanical emulsifier according to claim 1, wherein at least one of said separator necks is configured integral with one of said helix disks.

3. A mechanical emulsifier according to claim 1, wherein a plurality of said separator necks and a plurality of said helix disks are configured together as a unit.

4. A mechanical emulsifier according to claim 1, further comprising:

a) low-demand water injection metering means in communication with said water input for providing water injection to the fuel oil, said low-demand water injection metering means adapted to provide said water injection to the fuel oil in amounts related to a fuel demand of a diesel engine above a nominal stall-free rotational speed of said diesel engine; and b) said low-demand water injection means including means for stopping said water injection to the fuel oil, said stopping means adapted to stop the water injection to the fuel oil below said nominal stall-free rotational speed of said diesel engine.

* * * * *